US012092428B2

(12) United States Patent
Mrozicki

(10) Patent No.: US 12,092,428 B2
(45) Date of Patent: Sep. 17, 2024

(54) PERSISTENT MARKING OF A TARGET

(71) Applicant: BAE SYSTEMS plc, London (GB)

(72) Inventor: Antony Mrozicki, Camberley (GB)

(73) Assignee: BAE SYSTEMS PLC, London (GB)

( * ) Notice: Subject to any disclaimer, the term of this patent is extended or adjusted under 35 U.S.C. 154(b) by 32 days.

(21) Appl. No.: 18/040,691

(22) PCT Filed: Aug. 4, 2021

(86) PCT No.: PCT/GB2021/052007
§ 371 (c)(1),
(2) Date: Feb. 6, 2023

(87) PCT Pub. No.: WO2022/034289
PCT Pub. Date: Feb. 17, 2022

(65) Prior Publication Data

US 2023/0280132 A1 Sep. 7, 2023

(30) Foreign Application Priority Data

Aug. 13, 2020 (GB) ..... 2012650

(51) Int. Cl.
*F41G 3/14* (2006.01)
*F41H 13/00* (2006.01)

(52) U.S. Cl.
CPC ..... *F41G 3/145* (2013.01); *F41H 13/005* (2013.01)

(58) Field of Classification Search
CPC ..... F41H 13/005; F41G 3/145
USPC ..... 89/1.11
See application file for complete search history.

(56) References Cited

U.S. PATENT DOCUMENTS 5,050,476 A * 9/1991 McKnight ..... F41G 7/226 89/1.11
5,747,720 A * 5/1998 Schnurr ..... G01S 17/86 250/347
7,210,392 B2 * 5/2007 Greene ..... F41G 3/12 89/41.22
9,305,963 B2 * 4/2016 Balonek ..... H01L 27/14649
10,948,270 B2 * 3/2021 Jung ..... F41G 3/145
2009/0110019 A1 * 4/2009 Houde-Walter ..... F41G 1/36 372/55
2012/0256088 A1 * 10/2012 Balonek ..... F41G 3/145 250/492.1
2016/0161218 A1 * 6/2016 Laine ..... F41G 3/145 250/208.2
2016/0370149 A1 * 12/2016 Andorn ..... F41G 3/145
(Continued)

FOREIGN PATENT DOCUMENTS

JP 2004309049 A 11/2003
WO 2019013987 A1 1/2019
WO 2022034289 A1 2/2022

OTHER PUBLICATIONS

International Search Report and Written Opinion received for PCT/GB2021/052007. Mailed: Oct. 22, 2021. 17 pages.
(Continued)

*Primary Examiner* — John Cooper
(74) *Attorney, Agent, or Firm* — Finch & Maloney PLLC

(57) ABSTRACT

The present invention relates to a method of marking and identifying a target, and in particular, a method of using a Directed Energy Weapon (DEW) to heat a target without damaging it so that the target may be clearly identified by detectors and systems using thermally sensitive imaging.

20 Claims, 5 Drawing Sheets

(56) References Cited

U.S. PATENT DOCUMENTS

Figure 1:
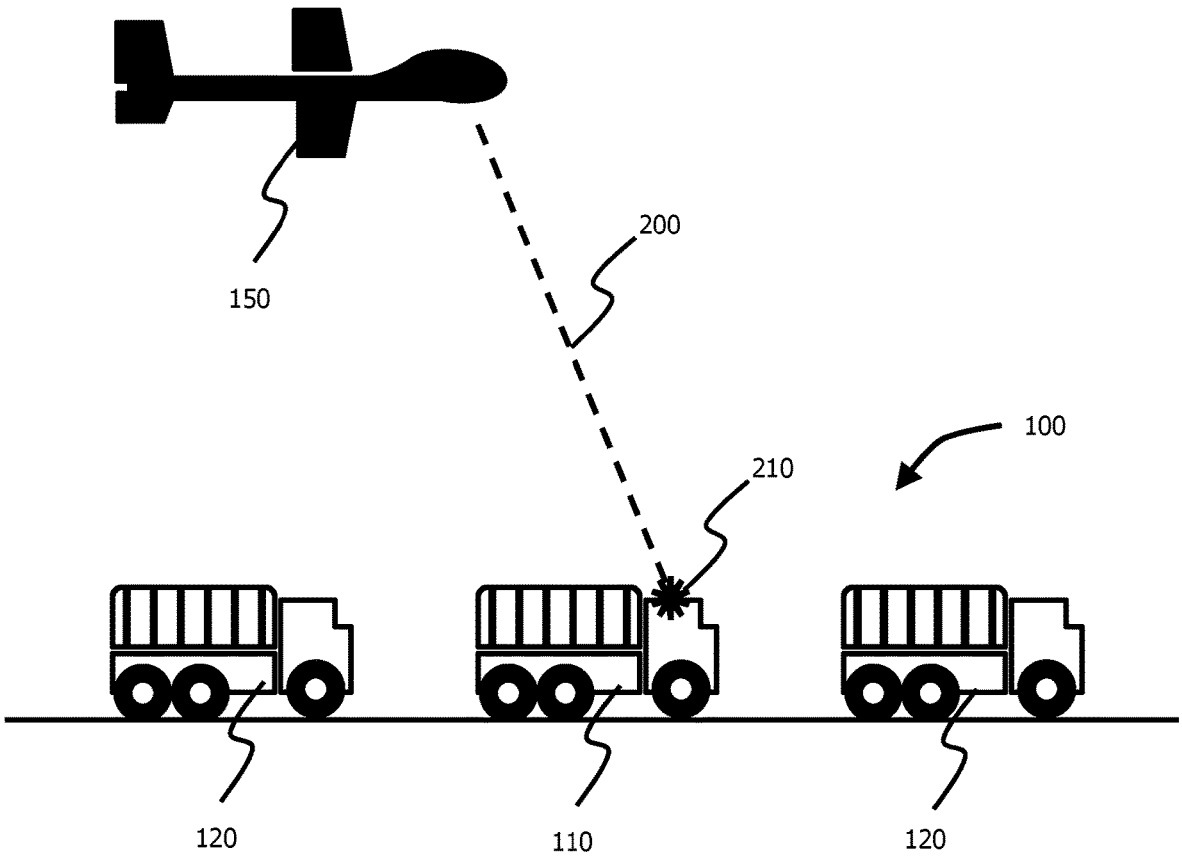

| | | | | |
|---|---|---|---|---|
| 2017/0199280 | A1* | 7/2017 | Nazemi | G01J 1/0295 |
| 2020/0025531 | A1* | 1/2020 | Jung | G01S 7/495 |
| 2020/0141704 | A1* | 5/2020 | Rigby | F41G 3/02 |
| 2021/0383506 | A1* | 12/2021 | Braunreiter | G06T 3/4069 |
| 2023/0056587 | A1* | 2/2023 | Knyazev | F41G 7/007 |

OTHER PUBLICATIONS

GB Combined Search and Examination Report under Sections 17 and 18(3) received for GB Application No. 2012650.4, dated Oct. 14, 2020. 6 pages.

* cited by examiner

PERSISTENT MARKING OF A TARGET

The present invention relates to a system for, and method of, marking and identifying a target. In particular, the present invention provides a system for and method of using a Directed Energy Weapon (DEW) to heat a target so that the target may be clearly identified by detectors and systems using thermally sensitive imaging.

BACKGROUND

Laser target designators are a known technology used to guide weapon systems (such as missiles, bombs or precision artillery munitions) onto targets "illuminated" by the laser target designator. The laser beam is invisible to the naked eye, but the laser signal reflected from the target may be detected by specialised equipment.

However, in order for the weapon system to be able to accurately identify and/or engage the target, this method requires continuous illumination of the target. If the direct line of sight between the designator and the target is interrupted, or if the laser designator is disengaged, the target is no-longer illuminated and the tracking and/or engagement of the target by the weapon system becomes less reliable.

The present invention attempts to solve this problem by providing a persistent target marking system and method.

SUMMARY OF INVENTION

In one example there is provided a method of marking a target. The method comprises illuminating a target with a directed energy weapon; heating up the target to a predetermined temperature using the directed energy weapon without damaging the target; ceasing discharge of the directed energy weapon; identifying the target using thermal imaging; and carrying out a specific task on the target.

Optionally, the steps of discharging the directed energy weapon and identifying the target are carried out by different platforms.

In one example, the target temperature is increased with an identifiable pattern on the target surface in order to differentiate between multiple thermally-marked targets.

In another example, the specific task to be carried out is any one of engaging the target with a weapon; continued surveillance the target; and continued heating of the target.

In one example, the directed energy weapon is a laser, i.e. an LDEW.

In another example of the present invention there is provided a directed energy weapon adapted to engage a target in order induce an enduring increase in temperature in the target, without damaging the target.

Optionally, the DEW may comprise a diffraction lens, allowing the target to be illuminated with an identifiable pattern.

In once example, the directed energy weapon is a laser.

Preferably, the power level of the weapon can be adjusted so as to ensure the target is not damaged.

FIGURES

Figure 2:
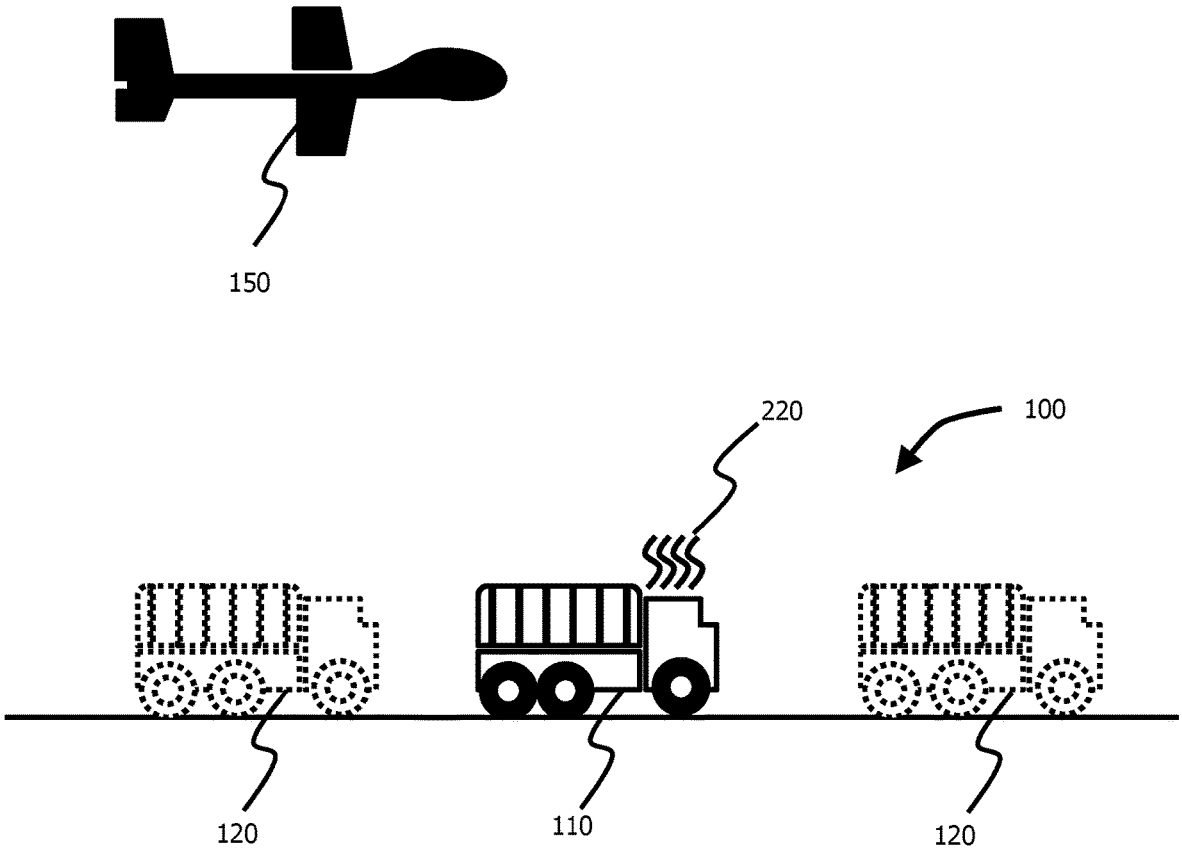
Figure 3:
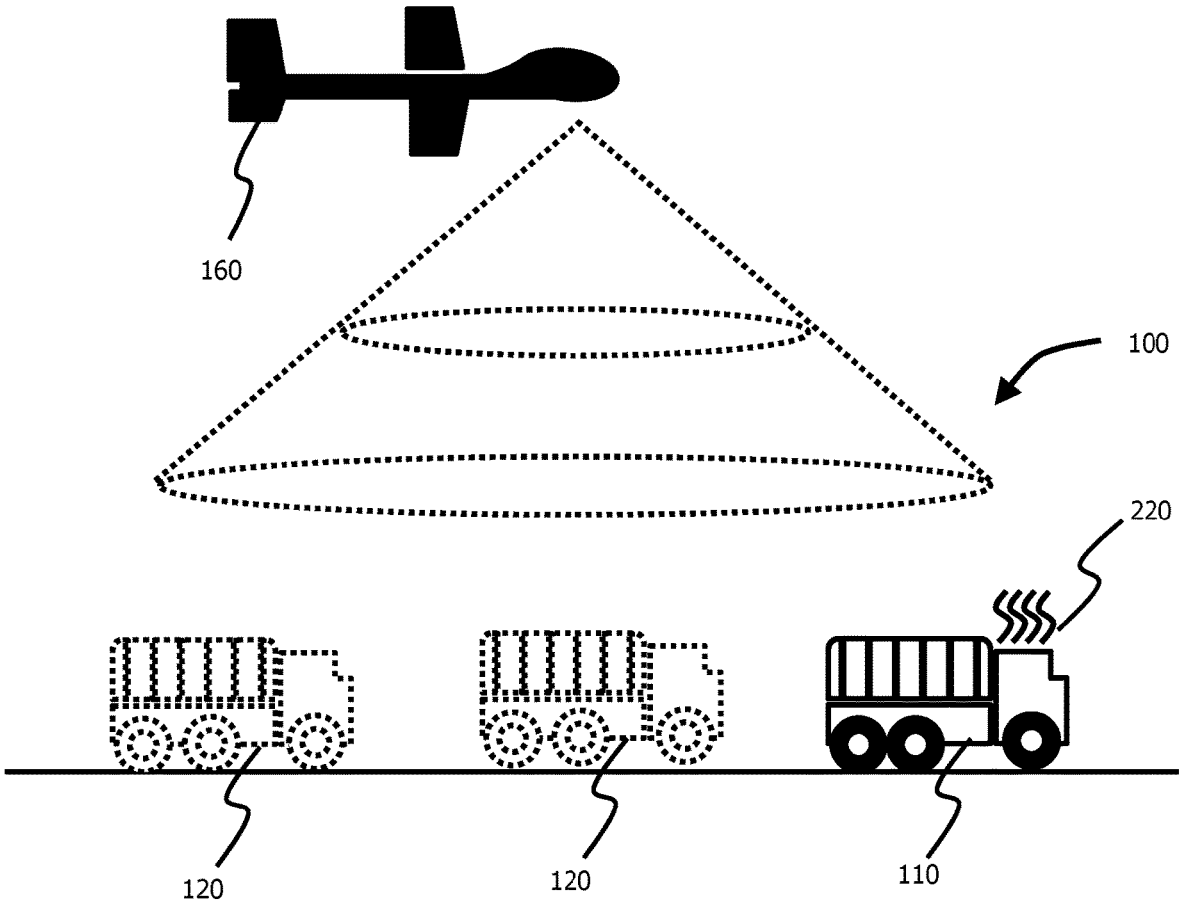
Figure 4:
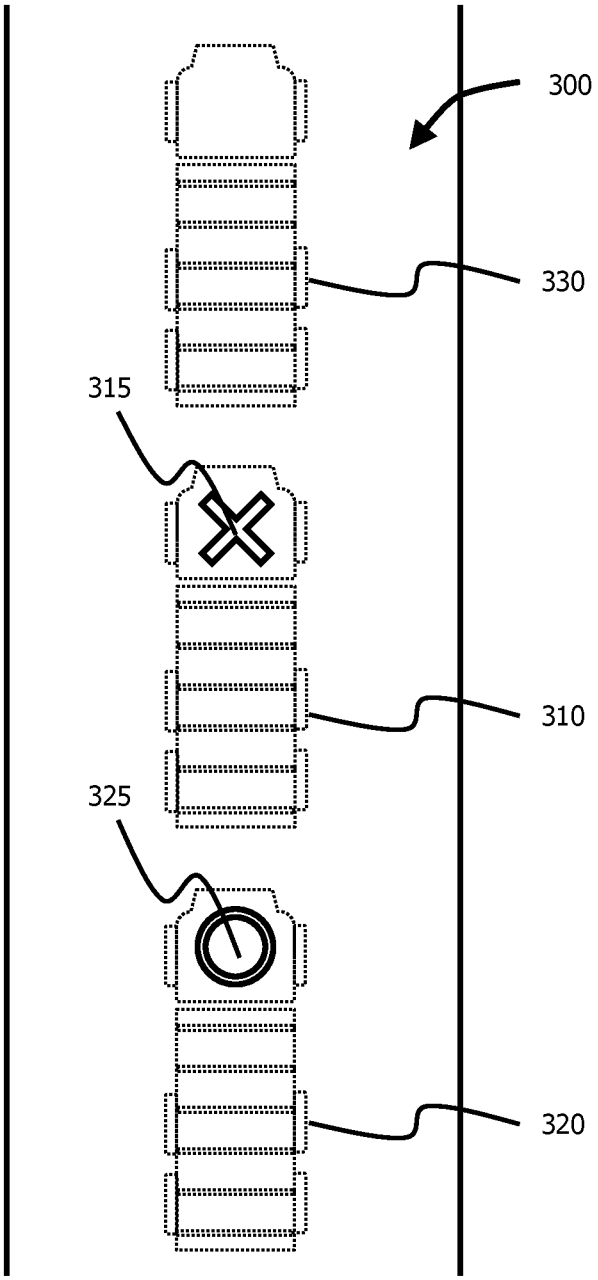
Figure 5:
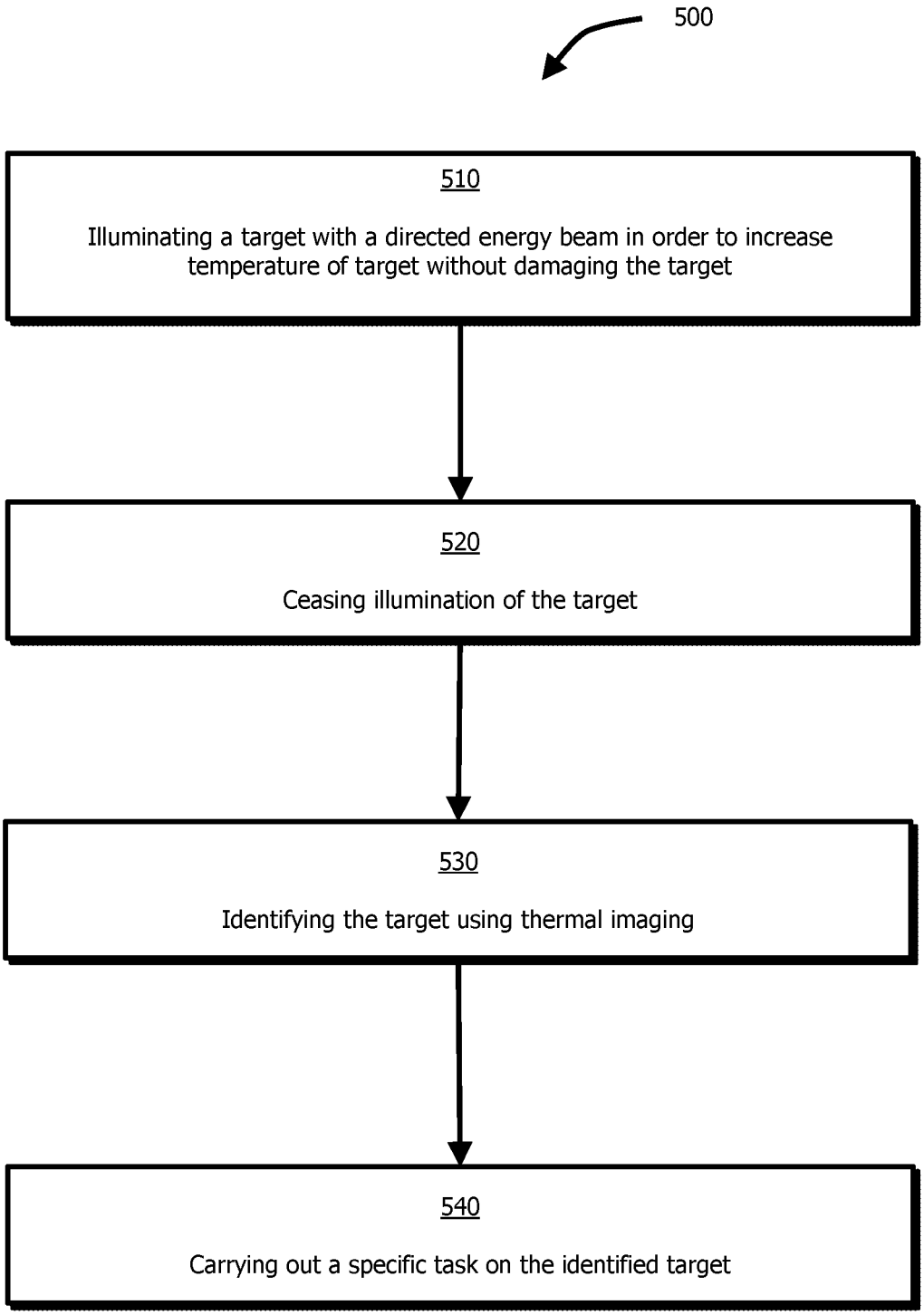

For a better understanding of the invention, and to show how embodiments of the same may be carried into effect, reference will now be made, by way of example, to the accompanying diagrammatic Figures in which:

FIG. 1 schematically depicts an example scenario wherein a target is thermally marked;

FIG. 2 schematically depicts an example scenario wherein a target's marking persists after disengagement of a marking beam;

FIG. 3 schematically depicts an example scenario wherein a target is identified after disengagement of a marking beam;

FIG. 4 schematically depicts an example scenario wherein multiple targets may be identified and distinguished from each other; and FIG. 5 is a flow diagram of an example method.

DETAILED DESCRIPTION

The present invention provides a system for, and method of, persistent marking of a target. The marking remains invisible to the naked eye, but can be detected by specialist equipment, e.g. thermal imaging. In particular, the invention relates to a system for and a method of thermally marking a target, or targets, so that they can be identified (and distinguished from each other) by thermal imagery equipment after the thermal marking has been disengaged, i.e. ceased to be applied to the target. The present invention provides an additional application of a directed energy weapon (DEW) system, which may already be adapted to provide a "soft-kill" application, where minor damage is used to deter or defeat the target, or a traditional "hard-kill" application, where the target is neutralised.

FIG. 1 shows an example situation where a target vehicle 110 is travelling in a convey 100 of other non-target vehicles 120. The target 110 is being followed by a reconnaissance aircraft 150 equipped with a DEW and tasked with identifying the target vehicle 110 for engagement by another platform. The DEW is first adjusted (either by the aircraft controllers, or remotely) so that the emitted energy beam 200 is not enough to damage the target 110, but high enough to cause adequate heating of the target at the point 210 where the directed energy beam 200 meets the target 110. The adjustment may involve factors such as the output power, the dwell time on the target or the focus area of the DEW beam. The reconnaissance aircraft 150 subsequently activates the DEW at a specified point 210 on the target vehicle 110, "illuminating" the target and thermally marking the target with a directed energy beam 200, so as to heat the target 110 but not damage it.

The location of the targeting will depend on the material make-up of the target 110, e.g. depending on the different thermal properties, or location of a weak spot so as to indicate and direct any future attack appropriately.

In some examples, the designating platform is equipped with a fully-powered DEW which can be adjusted to supply the energy required to thermal mark the target. The DEW can therefore be used for both thermal marking and disabling/damaging the target as the power levels are adjusted accordingly.

Other factors such as atmospheric conditions and dwell time on the target may also be taken into consideration when adjusting the DEW. For instance, a fully-powered DEW may be used to thermally mark the target if the dwell time is suitably low so as not to induce damage in the target. However, in other examples, it is also envisioned that the thermal marking device is a stand-alone tool that is power-limited so that it cannot be adapted to damage the target, but is powerful enough to thermally mark the target for identification later, after the DEW beam has been disengaged.

When remotely designating (i.e. illuminating or thermally marking) a target, there are a number of scenarios where the designation may be interrupted. For example, weather/cloud-cover may obscure the designator's line of sight.

Furthermore, the target may pass behind or under local scenery or buildings; third parties may move between the designator and the target; or the designator may move in relation to the target so that their line of sight is lost. Where this would be a problem for traditional laser designation weapons, this is solved by the present invention.

As shown in FIG. 2, the reconnaissance aircraft 150 ceases thermal marking (i.e. designation or illumination) of the target 110. This can be either a deliberate decision, for example the reconnaissance aircraft 150 can no longer follow the convoy 100 and has to return to base, or as a result of an interruption to the line of sight to the target, e.g. the convoy 100 passed through a tunnel. In any event, owing to the thermal marking 220 of the target vehicle 110, the heat signature (e.g. increased temperature in comparison with the surround target area and other vehicles in the convoy) remains after the thermal marking beam has been disengaged. Therefore, time may elapse between the illumination of the target 110, and hand-over to a separate tracker, or re-engagement by the same platform that initially thermally-marked (i.e. designated, illuminated) the target 100.

Whilst the heat signature 220 will of course decay/diminish over time, there will remain a window of opportunity after the thermal designator has been disengaged whereby the target 110 can still be identified, and distinguished from other targets if there are more than one, and a specific task carried out accordingly. This time period is dependent on properties of the targeted material, the specifications of the DEW applying the thermal marking, and/or the available dwell time of the energy beam on the target.

In the example shown in FIG. 3, at a time after the designating beam has been disengaged, a second aircraft 160 equipped with thermal imagery equipment is able to scan the convoy 100 and identify the target 110. In the example shown, the vehicles 110, 120 in the convoy 100 have changed relative positions since the first reconnaissance aircraft 150 was tracking them, i.e. when the target 110 was thermally marked. However, thanks to the persistent thermal marking 220, the target vehicle 110 is still identifiable within the convoy 100 to the thermal imaging equipment of the second aircraft 160.

Once the target 110 has been identified, a range of further actions may be carried out. For example, the identified target 110 may be engaged by a weapons system, surveilled further, or exposed to another application of a thermal tracking beam.

In the example shown in FIG. 4, more than one target is marked by the persistent thermal marking system and method. In this example, the directed energy weapon is adapted to mark the target in a pattern or shape. This could be achieved through either tracing the pattern across the surface of the target, e.g. "drawing" the pattern, or using a diffraction lens to heat up the target in a designated pattern. Two different target vehicles 310, 320 in a convoy 300 have been distinguished from each other (and indeed any other vehicles 330 in the convoy) by using a shaped thermal pattern 315, 325. It is now possible to tell, for example, which target is to be surveilled further, which is to be ignored, and which is to be engaged with a weapon system.

FIG. 5 shows a flow diagram of an example method 500. In a first step 510, the target is illuminated by a directed energy beam in order to increase the temperature of a target, whilst not damaging it. At a second step 520, the thermal marking beam is disengaged, and the target is no longer illuminated by the DEW. This may be a deliberate, e.g. the illuminating platform system having achieved the necessary thermal marking of the target, or an unintentional step, for example the target may pass behind a non-target. At a further step 530, thermal imaging is used to identify the thermally-marked target. Once the target has been identified, at step 540 a specific task is carried out. The task may be a pre-planned action, or may be decided at the time in light of the situation and conditions.

Whilst in the examples above there is a time window between the thermal tracking being disengaged and the subsequent identification of the target, in other examples the identification of the target and/or the specific task may initiated before the thermal tracking beam is disengaged, i.e. whilst the target is still being thermally "illuminated".

The present invention does not require a continued line-of-sight, or physical contact, to designate or track a target. Continuous or periodic demarcation of the target via a DEW may be used to prolong the tracking effect, or maintain a specific temperature in order to provide a distinguishable characteristic, for example where multiple targets are to be identified and distinguished from each other by different temperatures. In one example, the invention is implemented in an existing DEW system, i.e. with the accompanying thermal imagery, tracking and optics systems being adaptable between a "designating" mode and a "soft-kill" or "hard-kill" mode. In other examples, the thermal marking may be applied by a bespoke or stand-alone system. This could lead to a smaller and/or simpler thermal marking tool or system for more mobility.

In one example, the directed energy weapon incorporates a laser emitter, i.e. a laser directed energy weapon (LDEW). The LDEW can be finely tuned and accurately directed toward the target.

In another example, the DEW marking system is provided with thermal imagery equipment and is adapted to identify the coolest part of a target, and engage the DEW on the coolest part, so that the increased heat mark will be more easy identifiable against a cool background.

Furthermore, it will be apparent to the person skilled in the art that whilst in the examples above the target was a mobile ground unit, the system and method described herein would work just as well against a stationary target (e.g. a specific shipping container in a ship yard) at sea or on land, or a moving sea or air target (e.g. a particular weak-spot on a naval ship).

In an example whereby the DEW system is adapted to mark multiple targets in a target area, in order to differentiate between the multiple targets, the DEW system is adapted to heat different targets to different temperature levels. The targets can then be identified and distinguished from each other by observing their different heat signatures.

The present invention may also be used to identify a particular target location on a single target platform. For example, the thermal marking system and method may be employed to illuminate/designate a particular area on a vehicle (or other target type) which is vulnerable to attack, therefore ensuring that any subsequent attack is directed toward the weak-spot.

Whilst the above examples describe a DEW aboard an aircraft, it will be understood by the person skilled in the art that the DEW system could be located on a ground or water based platform, both static or mobile, or could be a hand-help personnel-carried system.

Similarly, whilst in the example above, the identification of the target is described as being carried out by an aircraft (either the same or different to the aircraft/platform that carried out the marking step), it will be appreciated by the person skilled in the art that the specialist thermal equipment could be located on a ground or water based platform, both static or mobile, or could be a hand-help personnel-carried system.

It would also be appreciated by the person skilled in the art that the specific task to be carried out after identification of the target could be carried out by the same party/platform that carried out the marking and/or identification steps, or an entirely different party. For example, the target may be thermally marked by a first aircraft, before being identified by a second ground-based unit, who initiates a ground-based weapon system that is remote to both the aircraft and the ground-based unit.

Whilst the aim of the invention discussed in the examples above is to thermally mark a target without damaging it, it will be appreciated by the person skilled in the art that this may include not appreciably damaging the target, i.e. to visible inspection. There may be undetectable damage carried out as a side-effect of the thermal marking process. However, if this damage is not visibly or easily detectable, then the invention has still achieved its goal. In other examples, minor damage may be incurred by the target, e.g. paint damage or minor scorching marks. This however may either go undetected, or will unlikely affect the operation of the target, and so therefore the invention has achieved its goal. Furthermore, in some examples, plastic or elastic deformation of softer parts of the target may also occur, however if the target is still able to operate as normal, and the deformation is minimal and/or goes undetected at the time of marking, then the invention has still achieved its goal. In essence, the invention seeks to thermally mark the target for later identification without disrupting the target or alerting the operator/passengers to the marking.

In summary, there is no longer a need for constant sight of the target by either a co-located or separate laser targeting system. By thermally marking a target, the illumination/demarcation effect will persist after line of sight is lost or the beam is disengaged (dependent on exposure length and material properties). This allows the target, or a precise aiming point on a larger target, to be identified by the same or separate systems, for a period of time during or after the initial engagement. The invention may be implanted in a number of scenarios where traditional designation and tracking methods are not appropriate, for example where a physical location tracker (e.g. GPS or other) may be compromised. Furthermore, the effect may be unnoticeable on large items (shipping containers/vehicles), and cannot be jammed or interrupted/masked in the same manner as existing methods.

The invention claimed is:

1. A method of marking at least two targets, the method comprising:

illuminating the at least two targets with a directed energy weapon;

heating up each of the at least two targets using the directed energy weapon without damaging the at least two targets, wherein a different pre-determined temperature is induced in each of the at least two targets;

ceasing illumination of the at least two targets with the directed energy weapon;

identifying and distinguishing the at least two targets based on the different pre-determined temperatures induced in each of the at least two targets using thermal imaging; and carrying out a specific task on at least one of the at least two targets based on the identification.

2. The method according to claim 1, wherein ceasing illumination and identifying the at least two targets are carried out by different platforms.

3. The method according to claim 1, wherein a temperature of the at least two targets is increased with an identifiable pattern on a respective target surface of each of the targets.

4. The method according to claim 1, wherein the specific task includes engaging at least one of the at least two targets with a weapon.

5. The method according to claim 1, wherein the specific task includes continued surveillance of at least one of the at least two targets.

6. The method according to claim 1, wherein the specific task includes continued heating of at least one of the at least two targets.

7. The method according to claim 1, wherein the directed energy weapon includes a laser.

8. A directed energy weapon adapted to engage at least two targets in order to induce an enduring increase in temperature in the targets without damaging the targets, wherein a different pre-determined temperature is induced in each of the at least two targets.

9. The directed energy weapon according to claim 8, comprising a diffraction lens, and wherein at least one of the at least two targets is illuminated with an identifiable pattern.

10. The directed energy weapon according to claim 8, wherein the directed energy weapon is a laser.

11. The directed energy weapon according to 8, wherein the power level of the weapon can be adjusted.

12. A method of marking targets, the method comprising:

distinguishably heating, via one or more directed energy weapons, a first surface of a first target to a first temperature and/or with a first thermal pattern, and a second surface of a second target to a second temperature and/or with a second thermal pattern;

identifying at least one of the first and second targets by using thermal imaging to detect temperature and/or thermal pattern of a corresponding target surface; and carrying out a specific task on at least one of the first and second targets.

13. The method according to claim 12, wherein heating and identifying are carried out by different platforms.

14. The method according to claim 12, wherein the specific task includes engaging at least one of the first and second targets with a weapon.

15. The method according to claim 12, wherein the specific task includes continued surveillance of at least one of the first and second targets.

16. The method according to claim 12, wherein the specific task includes continued heating of at least one of the first and second targets.

17. The method according to claim 12, wherein the directed energy weapon includes a laser.

18. The method according to claim 12, wherein prior to identifying at least one of the first and second targets by using thermal imaging, the method includes ceasing distinguishably heating the first and second targets.

19. The method according to claim 12, wherein distinguishably heating the first and second targets includes heating the first surface of the first target to the first temperature, and heating the second surface of the second target to the second temperature.

20. The method according to claim 12, wherein distinguishably heating includes heating the first surface of the first target with the first thermal pattern, and heating the second surface of the second target with the second thermal pattern.

* * * * *